United States Patent [19]

O'Fearna

[11] Patent Number: 4,576,364

[45] Date of Patent: Mar. 18, 1986

[54] PORTABLE WIND SCREEN

[76] Inventor: Patrick J. O'Fearna, 12449 ½Short Ave., Los Angeles, Calif. 90066

[21] Appl. No.: 584,853

[22] Filed: Feb. 29, 1984

[51] Int. Cl.[4] ..... E04H 17/16

[52] U.S. Cl. ..... 256/24; 256/23; 256/73

[58] Field of Search ..... 256/24, 25, 23, 73; 135/114, 108, 902; 248/188.5; 403/372

[56] References Cited

U.S. PATENT DOCUMENTS

| | | | |
|---|---|---|---|
| 1,315,497 | 9/1919 | Higdon et al. | 135/114 X |
| 2,777,454 | 1/1957 | Kramer | 135/118 X |
| 3,940,114 | 2/1976 | Rivelli | 256/25 X |
| 4,191,361 | 3/1980 | Jensen | 256/24 X |

FOREIGN PATENT DOCUMENTS

| | | | |
|---|---|---|---|
| 571617 | 1/1976 | Switzerland | 256/24 |
| 686349 | 1/1953 | United Kingdom | 403/372 |

*Primary Examiner*—Andrew V. Kundrat

*Attorney, Agent, or Firm*—Freilich, Hornbaker, Rosen & Fernandez

[57] ABSTRACT

A portable screen of fabric is held upright by a plurality of hollow poles clamped to the fabric by C clamps, preferably one the length of the pole. A stake is telescoped within each hollow pole, and held in an extended position (to adjust the height of the screen) by the friction of a resilient sleeve near the top of the stake, and additionally by a C clamp around the stake adjusted up against the pole. Straps are provided to secure the screen in a rolled up condition, and to carry the rolled up screen.

6 Claims, 6 Drawing Figures

PORTABLE WIND SCREEN

BACKGROUND OF THE INVENTION

This invention relates to improvements in wind screens, and more particularly to a screen of the type that can be rolled up for carrying. Such screens are most useful on the beach, but may be use in other places, such as around plants while spraying or during cold or windy weather.

Portable wind screens have been made of fabric supported in a vertical plane by poles attached to the fabric, such as by sewing a tube into the fabric through which the pole is inserted. The poles, which are rigid, are of sufficient length to have a protruding end that can be pushed into the ground (soil or sand) to stand the screen upright. An object of this invention is to improve the manner in which the fabric is secured to the poles for support. Another object is to provide telescoping poles with a construction that is economical to manufacture, is easily carried and easily adjusted in use, even after the poles are inserted into the ground, such as when the height of the screen is to be changed. Still another object is to provide a portable screen that permits stacking of one above another to increase the height of the screen. Yet another object is that the spacing between supporting poles can be easily changed in the field without the use of any implements.

SUMMARY OF THE INVENTION

These and other objects of the invention are achieved for a screen comprised of a single rectangular sheet of fabric and a plurality of hollow poles disposed parallel to each other along the length of the sheet. Each pole is placed on one side of the sheet and at least one C clamp placed on the pole over the sheet, preferably a single C clamp of a length substantially equal to the width of the sheet. Telescoped within the hollow pole is a stake (which may also be hollow) cut on one end at such an angle as to provide a sharp point for ease of insertion into the sand. A resilient sleeve is secured over the stake near the end remote from its sharp point. When the end of the stake with the sleeve is inserted into the hollow pole, sufficient friction is created by the resilient sleeve compressed between the hollow pole and the stake to hold it in whichever position the sleeved end of the stake is adjusted within the hollow pole. A C clamp on the stake may be included, and if so, it would be snugged up against the bottom of the pole to further hole the pole in its adjusted position on the stake. An adjustable carrying strap is secured to the fabric at one end with tabs of sufficient length to wrap around the screen, when rolled up from the other end. A fastener is provided to secure the tabs around the rolled up screen.

The novel features of the invention are set forth with particularity in the appended claims. The invention will best be understood from the following description when read in connection with the accompanying drawings.

DESCRIPTION OF PREFERRED EMBODIMENTS

Figure 1:
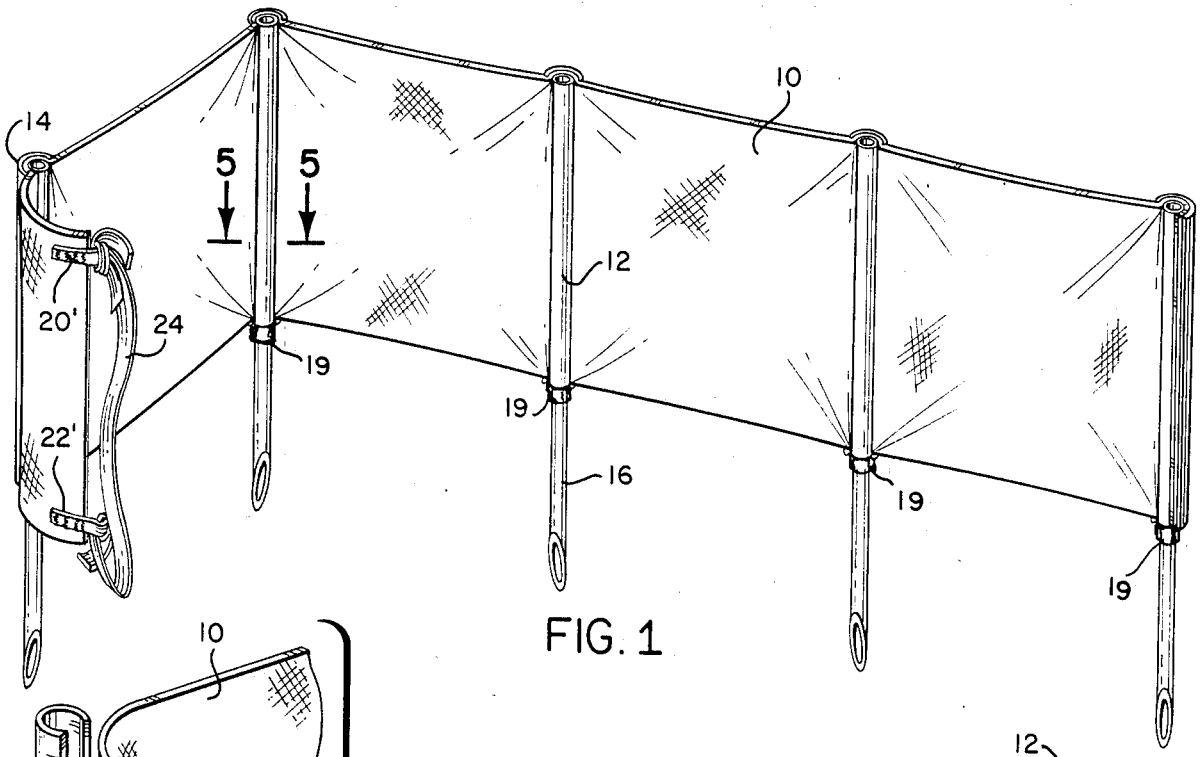
FIG. 1 is a perspective view of one side of a beach screen in an upright position that would be typical for use.
Figure 2:
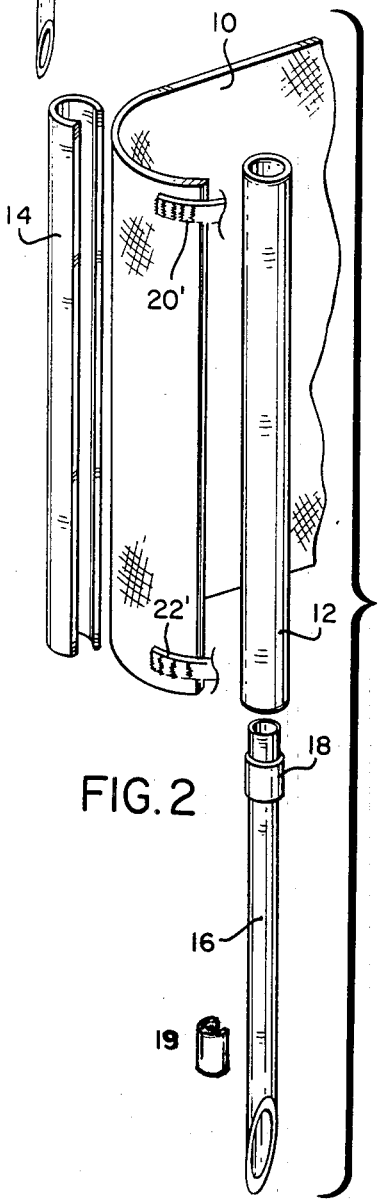
FIG. 2 is an exploded view of the telescoping pole assembly secured to the screen by a C clamp.
Figure 3:
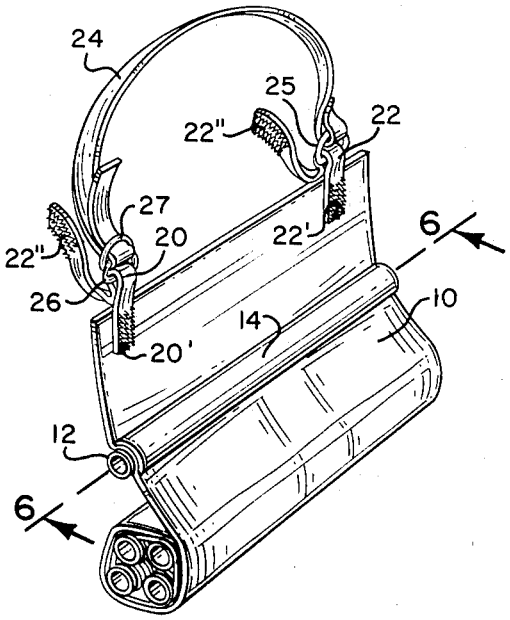
FIG. 3 is a perspective view of the screen of FIG. 1 nearly rolled up for carrying from a strap secured to one end.

Referring now to the drawings in more detail, an upright beach screen is shown in FIG. 1 comprised of a rectangular sheet 10 of a suitable fabric, such as light weight rip-stop nylon commonly used for back packing equipment, and hollow support poles 12 of a length equal to the width of the sheet. The sheet is preferably one continuous piece hemmed along its four edges, or heat treated to fuse the threads of the fabric along the edge, thereby preventing fraying of the fabric, and secured to the poles by C clamps 14 shown in FIG. 2. Telescoped within the support poles are stakes 16 cut to a sharp point at the lower end, and having a resilient sleeve 18 secured to the stake at its upper end. The sleeve may be secured by a suitable adhesive, and in fact may be formed by simply wrapping electricians tape (rubber or fabric) around the stake.

A C clamp 19 on the stake 16 is adjusted in position at the lower end of the support pole 12 to aid in holding the pole up in its raised position. However, such a C clamp is not absolutely necessary because the resilient sleeve is sufficient, as long as the sleeve remains resilient, with a high coefficient of friction against the inside of the pole. Also, when stacking one screen above the other, the stakes of the upper screen fit into the top of the poles of the lower screen. The poles of the lower screen then aid in holding the poles of the upper screen raised on its stakes so that there again the C clamps on the stakes are not necessary.

Figure 4:
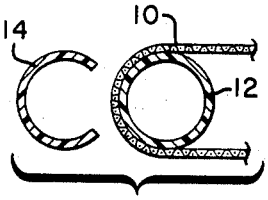
FIG. 4 is a top view of the pole and screen fabric with the C clamp of FIG. 2 not yet over the screen fabric.

FIG. 4 is a top view of a pole 12 with the screen fabric (sheet 10) held tight against it, ready for the C clamp 14 to secure it to the pole. Although several C clamps of short length could be used, such as one near the top of the screen and one near the bottom, it is preferable to use a single C clamp of a length virtually equal to the length of the pole which is equal to the width of the sheet 10.

Figure 5:
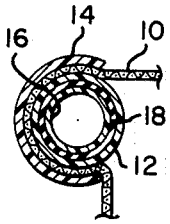
FIG. 5 is a top view of the pole and screen fabric with the C clamp of FIG. 2 in position to secure the fabric to the pole.

The hollow pole 12 may be made of metal or rigid plastic, and the C clamp should be made of some material that is sufficiently flexible to allow it to be opened enough to fit over the sheet 10 against the pole 12. Both the pole and the C clamp may be made from the same stock of plastic (PVC) tubing, i.e., tubing of the same diameter and wall thickness, but in practice the poles may be made of one material, such as aluminum tubing, and the clamps of another more resilient material, such as PVC tubing with a section cut out along its entire length. It is only necessary that the tubing from which the clamps are made have an internal diameter less than the outside diameter of the pole. FIG. 5 shows in a top view the C clamp 14 fitted over sheet 10 on the pole 12.

By making the C clamp from the same tubing as the poles, it is certain that the internal diameter (ID) of the C clamp will be less than the outer diameter (OD) of the pole. As just noted above, it is only important that the ID of the C clamp be less than the OD of the pole. This will assure that expanding the C clamp to fit over the pole will produce sufficient pressure against the pole to hold the sheet in place. Cutting a longitudinal section out of the tubing from which the C clamp is made will facilitate placing the clamp over the fabric and pole. The thickness of the sheet will, of course, add to the OD of the pole, but since the sheet is very thin, especially if made of light weight rip-stop nylon fabric, that added thickness may not stress the C clamp sufficiently to provide the needed pressure against the fabric over the pole.

It should be noted that, except for hemming or otherwise treating the edges of the fabric so it will not fray, there is no stitching or other work required to be done on the sheet, with the further exception of stitching on tabs 20, 22 for an adjustable carrying strap 24. Manufacture and assembly is thus greatly facilitated. A further advantage is that reassembly is also facilitated, as when a user wants to add or space poles closer together, remove poles to reduce bulk and weight, or space poles differently for design.

One ring 25 is shown in FIG. 5 stitched in the tab 22 for permanently securing one end of the strap 24 to the sheet 10. Two rings 26, 27 are stitched in the tab 20 to secure the other end of the strap 24 in the usual manner, which is with the end of the strap looped through the inside of both rings in sequence and then looped over the outside of the second ring back through the first ring. Any tension on the strap will then pull the second ring against the first to hold the strap firmly between the rings. The greater the tension, the more firmly the strap is held.

Figure 6:
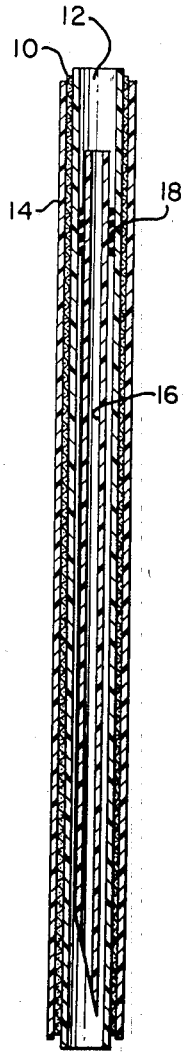
FIG. 6 is a longitudinal cross section taken along line 6—6 in FIG. 3 of the pole, screen fabric and C clamp assembled, and a telescoping stake in the pole.

While the screen is being stored or carried, the telescoping stakes 16 are pushed inside the poles, as shown in FIGS. 5 and 6. The friction of the resilient sleeve 18 will hold it in place. To put the beach screen in use, the stakes can be pushed out with a finger inserted at the top of the pole sufficiently to cause the pointed end of the stake to protrude. Then grasping that pointed end, each stake is pulled out sufficiently to hold the screen upright when inserted into the ground. When the stake is hollow, as in the preferred embodiment shown, it is easy to stick the stakes into the ground where there is sand or loose soil. Once the screen has been put in place upright, its height above the ground may be adjusted by pulling each of the poles up on its stake against the friction of the sleeve between the stake and the inside of the pole. A second screen may also be stacked on the first by inserting the stake of the second screen into the poles of the first screen, as suggested hereinbefore. That is an inherent advantage of the unique structure disclosed using telescoping stakes in hollow poles.

To store or carry the screen, it is rolled up, starting at the end remote from the strap 24. The tabs 20 and 22 at the other end have free sections 22'' extending a length sufficient to wrap around the rolled up screen. Each of the tabs stitched to the sheet 10 has secured to it (on the outside) half of a fastener, such as a Velcro fastener, although a snap fastener could also be used. The other half of the fastener is then secured to the free end of the tab on the inside so that once wrapped around, the free end is secured to the stitched end of the tab. For example, using Velcro fasteners, a section 20' having loops is stitched to the tab 20 at the secured end thereof, and a section 22' is similarly secured to the other tab 22. Sections 20'' and 22'' having hooks are then secured to the free ends of the tabs 20 and 22 on the sides thereof that overlay the sections 20' and 22' when the screen is rolled up.

Although particular embodiments of the invention have been described and illustrated herein, it is recognized that modifications and variations may readily occur to those skilled in the art. Consequently, it is intended that the claims be interpreted to cover such modifications and variations.

What is claimed is:

1. A portable beach screen comprised of a rectangular sheet of fabric, a plurality of hollow poles disposed parallel to each other along the length of the sheet, each pole being placed against said sheet, a plurality of C clamps, at least one clamp placed over each pole with said sheet clamped therebetween, a plurality of stakes, a separate stake telescoped within each pole, each stake having a point at one end and resilient sleeve near the end thereof remote from said point, said sleeve being of sufficient thickness to be compressed between said stake and the hollow pole into which said stake is inserted.

2. A portable beach screen as defined in claim 1 wherein said C clamp is of a length substantially equal to the width of said sheet.

3. A portable beach screen as defined in claim 2 wherein said pole is of a length substantially equal to the width of said fabric.

4. A portable beach screen as defined in claim 2 wherein said C clamp is comprised of tubing of smaller internal diameter as the external diameter of said pole with a section cut out along the entire length of said tubing.

5. A portable beach screen as defined in claim 1 including two tabs secured to the fabric at one end thereof, one near each side, and a carrying strap attached to said tabs, said tabs being of a length sufficient to warp around said portable screen, when rolled up from one end to the end having said tabs, and a fastener for each tab to secure it around said portable screen.

6. A portable beach screen as defined in claim 5 including means for adjusting the length of said carrying strap between said two tabs.

* * * * *